US007120269B2

(12) United States Patent
Lowell et al.

(10) Patent No.: US 7,120,269 B2
(45) Date of Patent: Oct. 10, 2006

(54) LAY-IN TILE SPEAKER SYSTEM

(75) Inventors: Wilhelm R. Lowell, St. Louis, MO (US); Carey C. Porter, Beaufort, MO (US); Jeffrey R. Garstick, Ballwin, MO (US)

(73) Assignee: Lowell Manufacturing Company, St. Louis, MO (US)

( * ) Notice: Subject to any disclaimer, the term of this patent is extended or adjusted under 35 U.S.C. 154(b) by 915 days.

(21) Appl. No.: 09/972,465

(22) Filed: Oct. 5, 2001

(65) Prior Publication Data

US 2003/0068049 A1 Apr. 10, 2003

(51) Int. Cl.
*H04R 1/02* (2006.01)

(52) U.S. Cl. ..... 381/386; 381/396; 381/87; 181/171

(58) Field of Classification Search ..... 381/396, 381/386, 395, 87; 181/171
See application file for complete search history.

(56) References Cited

U.S. PATENT DOCUMENTS

| | | | | |
|---|---|---|---|---|
| 2,830,330 | A | 4/1958 | Heath | |
| 3,666,040 | A * | 5/1972 | Junk | 181/150 |
| 3,912,865 | A | 10/1975 | Seebinger | |
| 4,057,689 | A | 11/1977 | Stallings, Jr. | |
| 4,330,691 | A | 5/1982 | Gordon | |
| 4,484,658 | A | 11/1984 | Grote | |
| 4,509,192 | A | 4/1985 | Straughn | |
| 4,727,587 | A | 2/1988 | Black | |
| 4,923,032 | A | 5/1990 | Nuernberger | |
| 5,088,574 | A | 2/1992 | Kertesz, III | |
| 5,316,254 | A | 5/1994 | McCartha | |
| 5,533,306 | A | 7/1996 | Aspenson | |

OTHER PUBLICATIONS

Quam-Nichols Co.; The TR Lay-in Speaker System from Quam; Web site pages, 2001.
Atlas Sound,; 1'×2' Drop-In Speaker Systems, Installs Hassle-Free; Atlas Sound Product Catalog; 2001.

* cited by examiner

*Primary Examiner*—Vivian Chin
*Assistant Examiner*—Con P. Tran
(74) *Attorney, Agent, or Firm*—Husch & Eppenberger LLC; Rebecca J. Brandau

(57) ABSTRACT

A lay-in tile type system is disclosed for supporting speakers in a new or existing suspended ceiling includes a perforated base section providing maximum free air space. A perforated surface also helps the lay-in tile system blend in with the overall suspended ceiling in which the system is installed. The system further provides integral flanges that form a T-shaped member to support at least a portion of an adjacent ceiling tile, obviating the need to purchase, cut and install a replacement grid member. The base and the flanges are constructed from a single sheet of material that is folded to form the flanges. The base is sized to fit within a portion of a conventional ceiling tile grid opening, and has substantially ninety degree comers so that the ceiling grid opening is completed by a ceiling tile sized with a simple straight cut, simplifying installation.

19 Claims, 8 Drawing Sheets

LAY-IN TILE SPEAKER SYSTEM

BACKGROUND OF INVENTION

This invention relates generally to a loud speaker system and more particularly to a speaker support system for use in a new or existing conventional suspended ceiling, which system includes an integral t-shaped flange to thereby facilitate installation of the system.

Suspended ceilings are typically constructed of a suspended metal grid, the grid having ceiling grid openings into which acoustic tiles or panels are assembled to create the ceiling. Often it is desired to include a speaker system within the ceiling. The customary procedure for installing a speaker into an acoustic tile ceiling includes cutting a hole in a tile and mounting the speaker therein. This is a time consuming and often difficult procedure that results in the speaker being clearly visible in the ceiling.

Attempts have been made to provide alternative support systems. Unfortunately, due to the complexity of these systems, they tend to be costly to manufacture, complicated to assemble and thus timely and expensive to install. These systems often require multiple or intricate cuts to the ceiling tile and/or consist of multiple piece supports that must be assembled during installation.

It is therefore an object of the present invention to provide a loud speaker support system that is quickly and easily manufactured and installed into a new or existing suspended ceiling.

It is another object of the present invention to provide a speaker support system that can be easily adapted to mount a variety of speaker types and sizes including both music and pager systems, for example.

It is yet another object of the present invention to provide a speaker support system that is visually integrated into a new or existing suspended ceiling.

SUMMARY OF INVENTION

To accomplish the foregoing and other objects of the present invention there is provided a lay-in tile type of speaker support system for use with suspended ceilings. The system may support various sizes and types of speakers, such as stereo or paging systems. The system includes a speaker support base that can be perforated to improve acoustics by providing maximum free air space. The perforated surface also helps the appearance of the new system to visually blend in with the overall suspended ceiling in which the system is installed. The system further provides integral flanges that form a T-shaped member, when viewed in section, to support at least a portion of a ceiling tile cut to complete to ceiling grid opening. In a preferred embodiment the base and the flanges are constructed from a single sheet of material that is folded to form the flanges. A preferably substantially solid support plate may be utilized to strengthen the base. When the support plate is utilized it is placed against the base and the speaker is mounted to the support plate. The speaker can be mounted with or without a back box. The base is sized to fit within at least a portion of a conventional ceiling tile grid opening, and has substantially ninety degree corners so that the ceiling grid opening is completed by a ceiling tile cut to size with a simple, straight cut. In one embodiment the base occupies about one half of the ceiling grid opening and the cut ceiling tile completes the other half of the grid opening. In another embodiment the base occupies about one quarter of the ceiling grid opening and the cut ceiling tile occupies about three quarters of the ceiling grid opening. If desired, the new system can be also be sized to fill a complete ceiling tile opening. So, it can be readily seen that the new system offers a great degree of flexibility to the art of ceiling speaker installation.

Thus, in view of the above objects and advantages, the invention is, briefly, a speaker support system adapted for use with a suspended ceiling of the type having a suspended ceiling grid including a plurality of ceiling grid openings and a plurality of ceiling panels sized to fit within the ceiling grid openings. The speaker support system includes a speaker support base capable of supporting at least one speaker within the grid opening without interfering with the operation of the speaker and a guide flange integral to the speaker support base. The guide flange is adapted to align at least a portion of a ceiling tile within the ceiling grid opening. There is also in the system a support flange integral to the base portion. The support flange is adapted to support at least a portion of the ceiling tile within the ceiling grid opening so that at least a portion of the ceiling grid opening is filled with the speaker support base and the remaining portion of the ceiling grid opening is filled with the portion of the ceiling tile.

These and other objects and advantages will be in part apparent and in part pointed out herein below.

BRIEF DESCRIPTION OF THE DRAWINGS

Throughout the figures like elements are indicated by like numbers.

DETAILED DESCRIPTION

Figure 2:
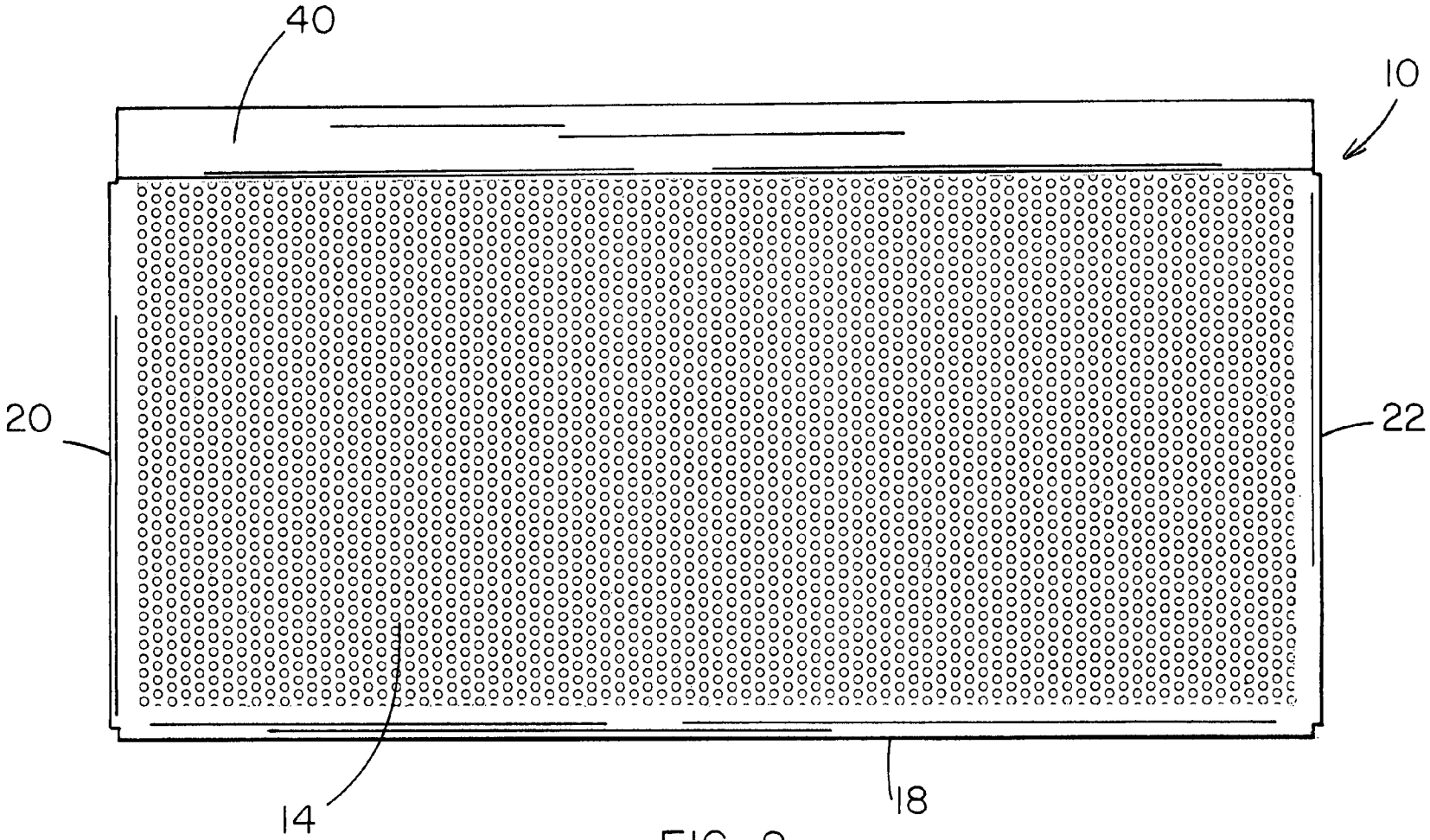
FIG. 2 is a plan view of the side of the system that is exposed when the system is in place in a ceiling.
Figure 3:
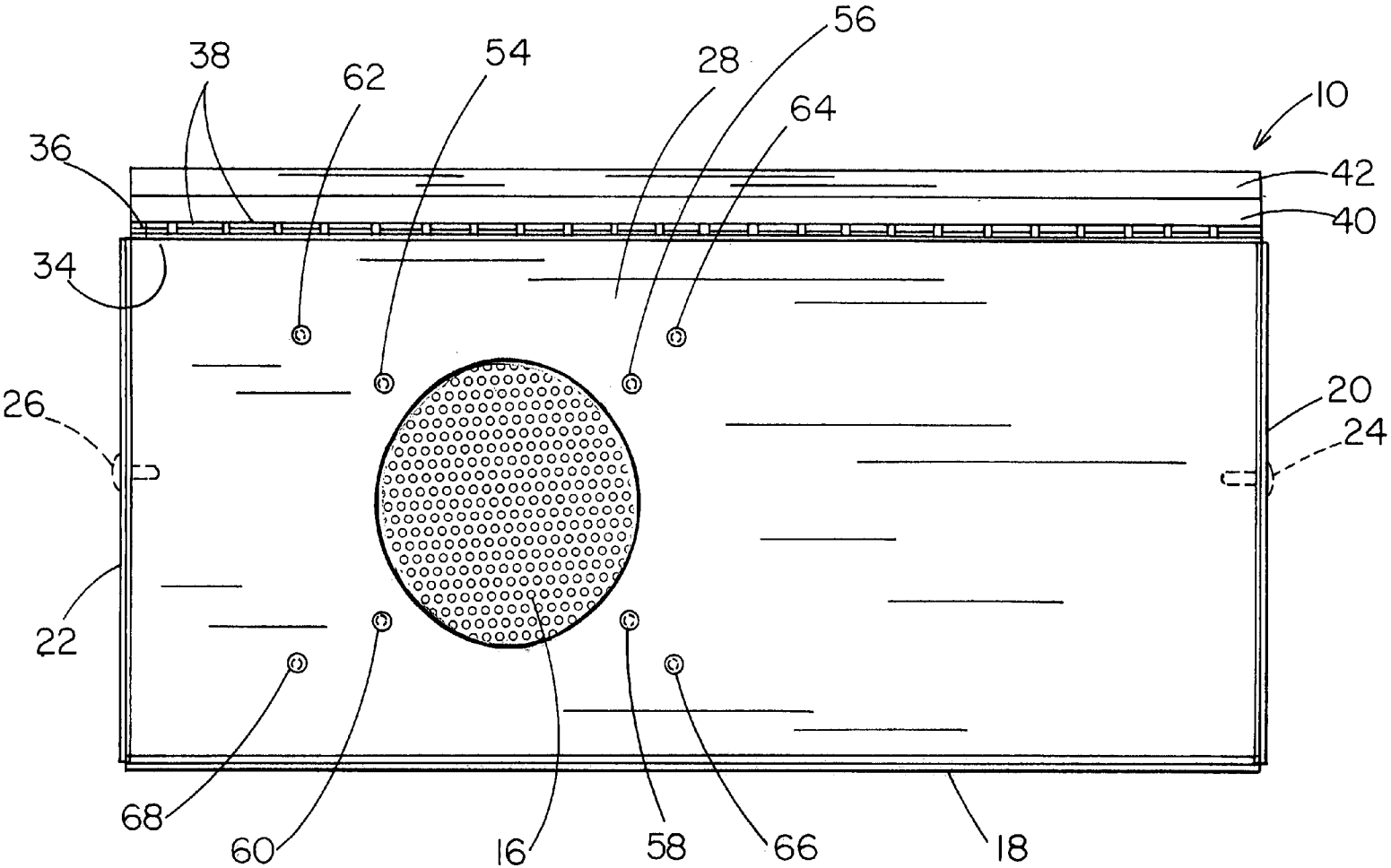
FIG. 3 is a top plan view of the system of FIG. 1.
Figure 4:
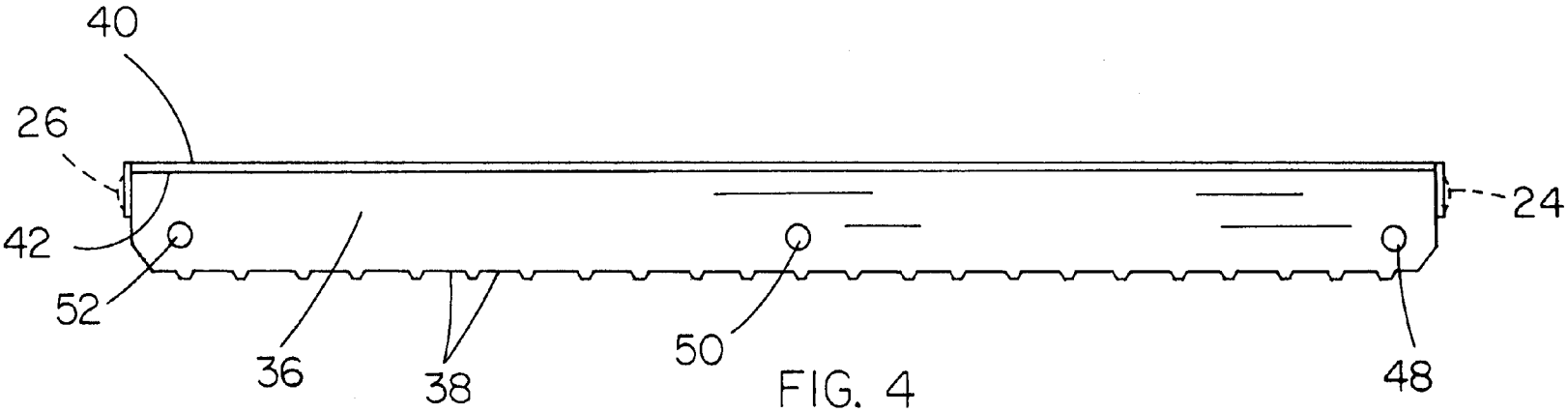
FIG. 4 is a side elevational view of the system of FIG. 1, taken from the front of FIG. 1 and inverted.
Figure 5:
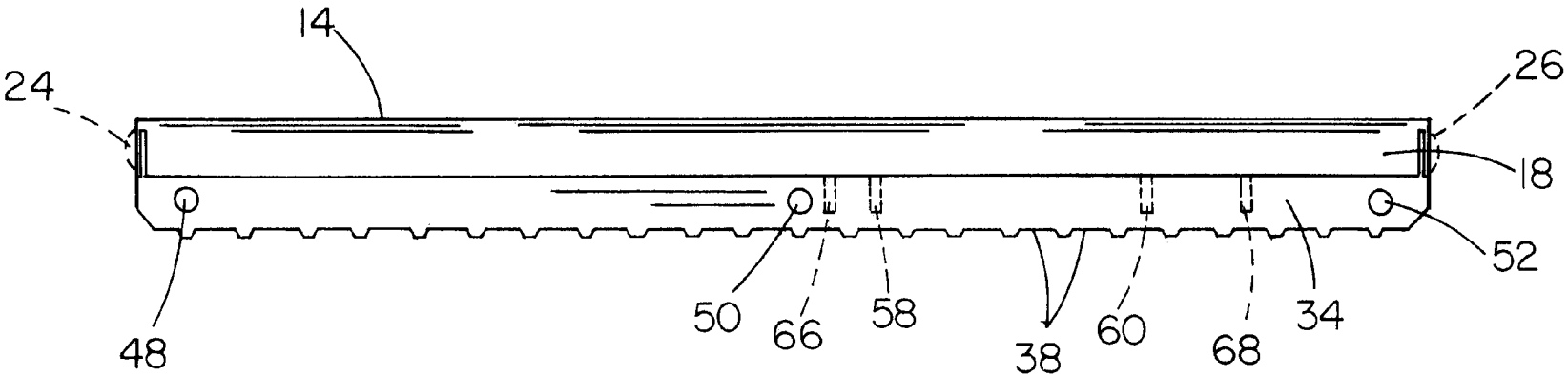
FIG. 5 is a side elevational view of the new system taken from the opposite side of FIG. 4.
Figure 6:
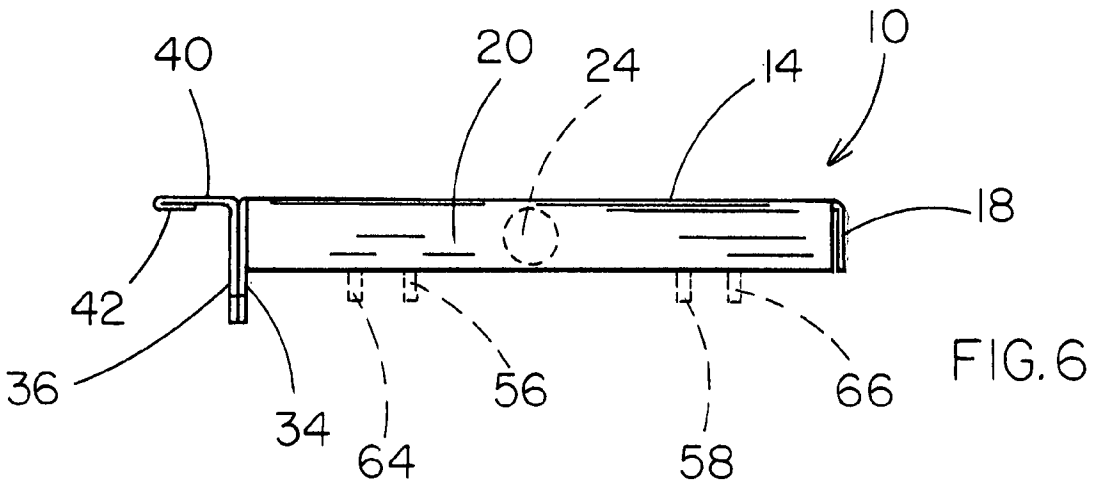
FIG. 6 is an end elevational view of the new system taken from the left side of FIG. 2.
Figure 7:
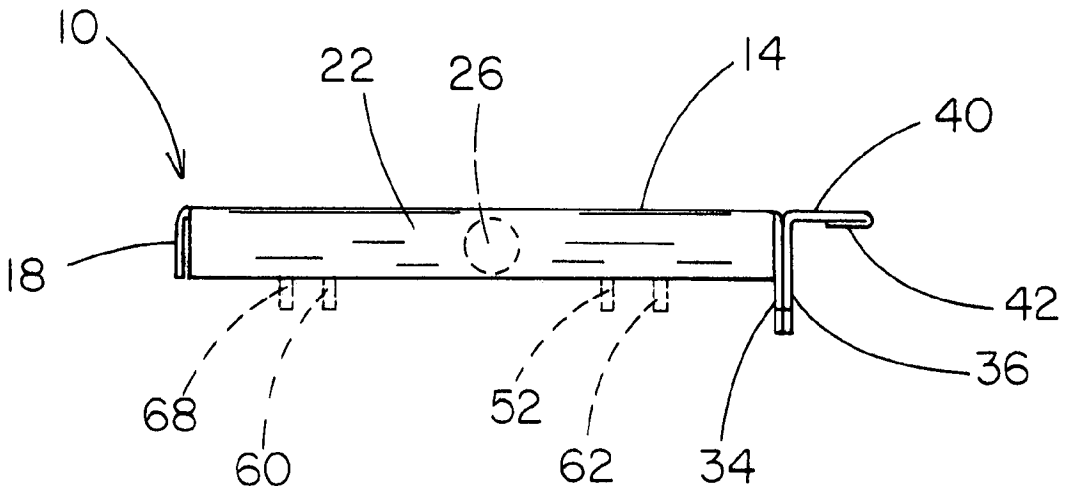
FIG. 7 is an end elevational view of the new system viewed from the right side of FIG. 6.
Figure 8:
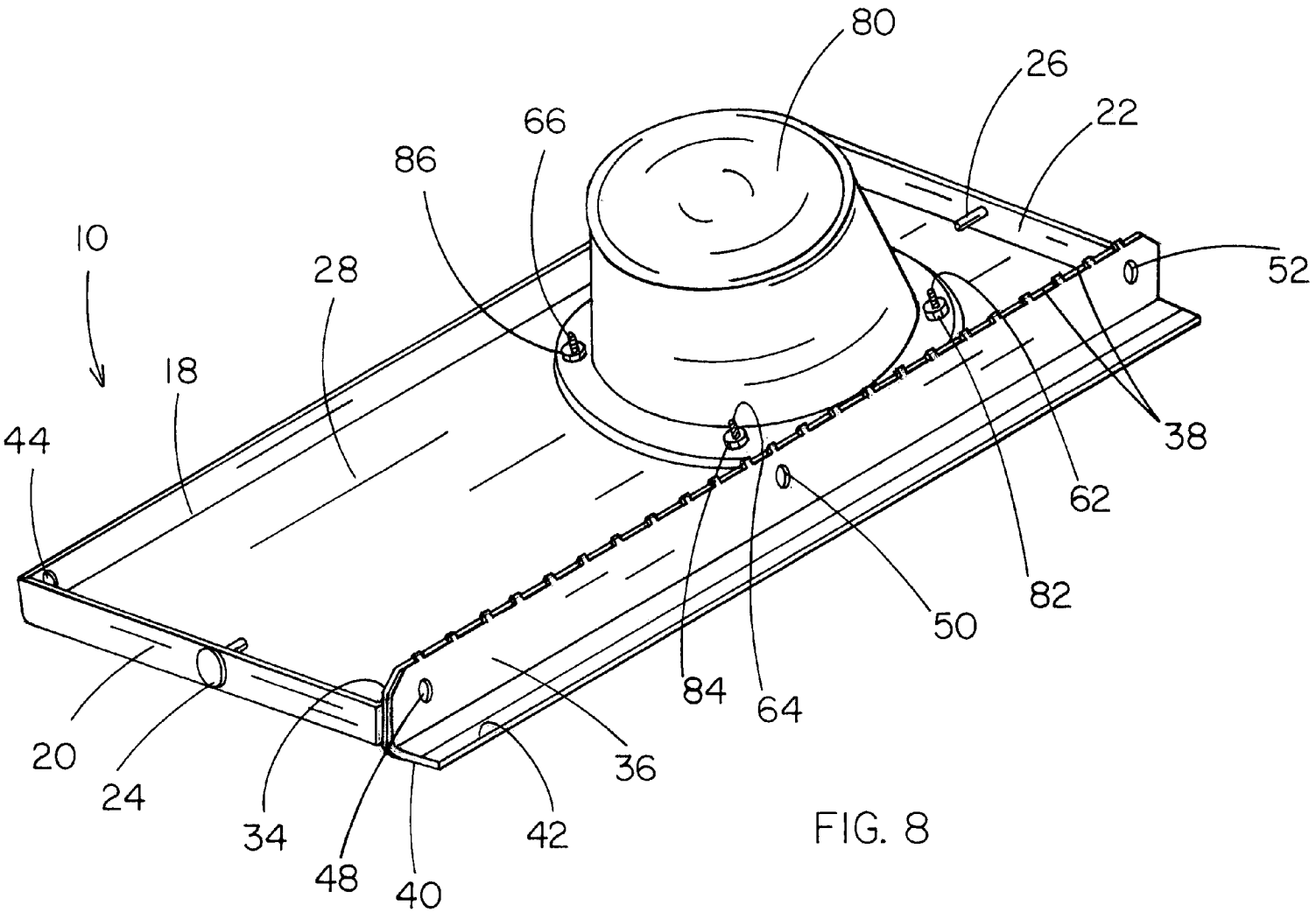
FIG. 8 is a perspective view of the system of FIG. 1 with a speaker back box mounted on the system.

There is shown in the Figures a preferred embodiment of the speaker support system of the present invention generally designated 10. System 10 includes a speaker support base 12 of a material suitable for supporting a speaker, such as lightweight metal or polymer. Base 12 has a front side 14 that faces into the room when the system is installed, and a back side 16 onto which the speaker is secured. In a preferred embodiment, base 12 is sized one by two feet, in order to fill about one half of a two foot square ceiling grid opening or about one quarter of a two by four foot ceiling grid opening. As is best illustrated in FIG. 2, support base 12 may be perforated, the fine perforations providing maximum free-air space for improved speaker sound transmission while visually integrating system 10 into the new or existing tile ceiling. Projecting from support base 12 are flanges 18, 20 and 22 that increase the strength of system 10 and thus the stability thereof in normal use position. In the illustrated embodiment these flanges are integral to speaker support base 12. Flanges 20 and 22 include pins 24 and 26 or other suitable fasteners that may be added to secure a support plate 28 to base 12.

Figure 1:
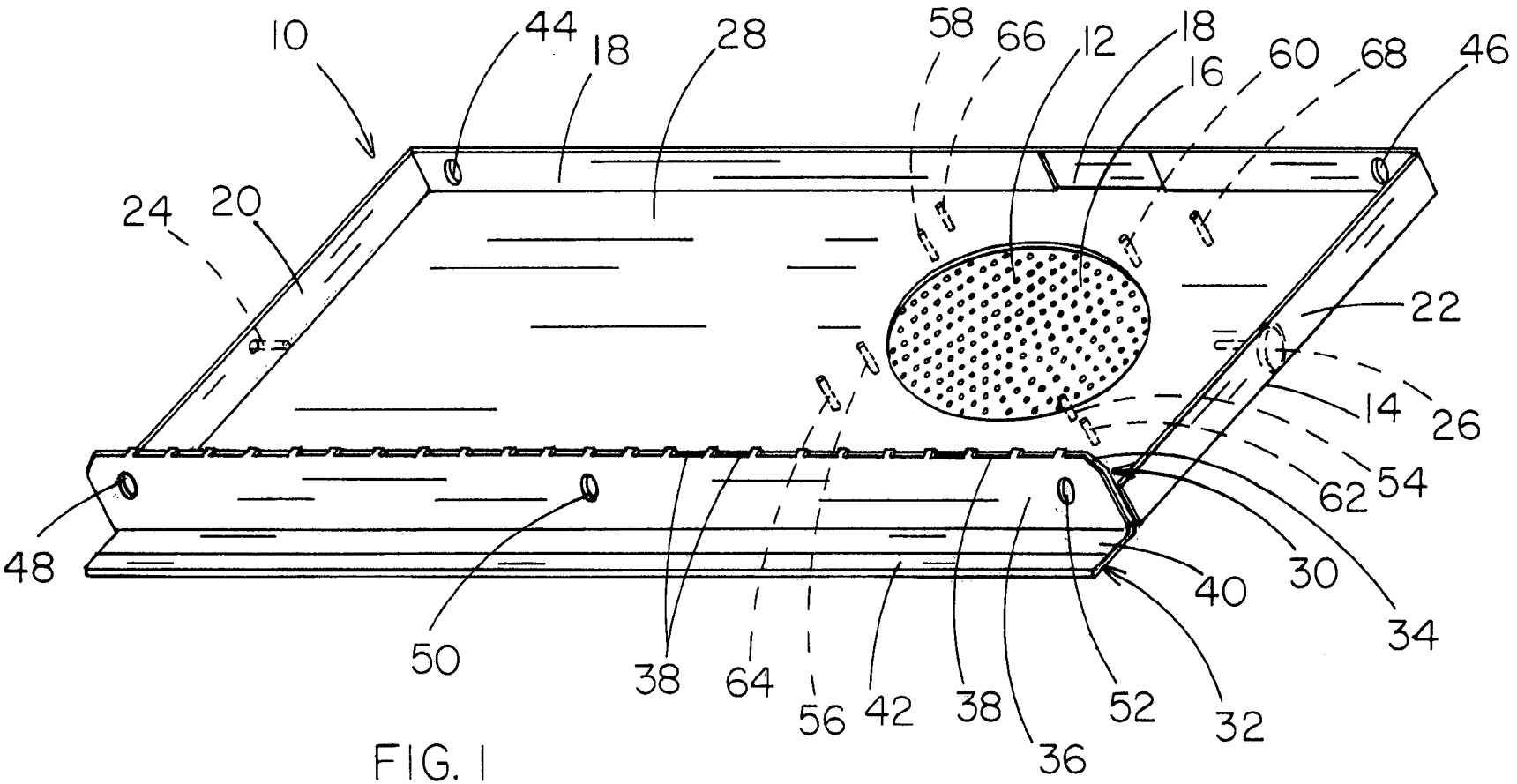
FIG. 1 is an upper perspective view of the speaker support system of the present invention illustrating the side of the system to which the speaker is normally mounted.

System 10 further includes a guide flange generally designated 30 and a support flange generally designated 32. Flanges 30 and 32 together form an integral generally T-shaped (upside down) ceiling tile support. In the illustrated embodiment, base 12 and flanges 30, 32 are formed from a single sheet of material, preferably a lightweight metal or suitable polymer. Guide flange 30 is formed by folding the material to a substantially 90° angle to form an ascending (when system 10 is positioned in then normal use position shown e.g. in FIGS. 1 and 10) flange section 34 and then folding the material back upon itself to form a descending flange section 36. A plurality of slots 38 are preferably formed into the material prior to folding to facilitate construction without weakening the system.

Support flange 32 includes a support section 40 that intersects and is transverse to flange section 36 and is substantially planar with base 12 and a reinforcement strip 42. In the embodiment shown in the figures, flanges 18 and 30 include holes 44, 46 and 48, 50, 52 respectively. These holes allow system 10 to be wired or otherwise secured to the building if desired or if required by code.

Figure 9:
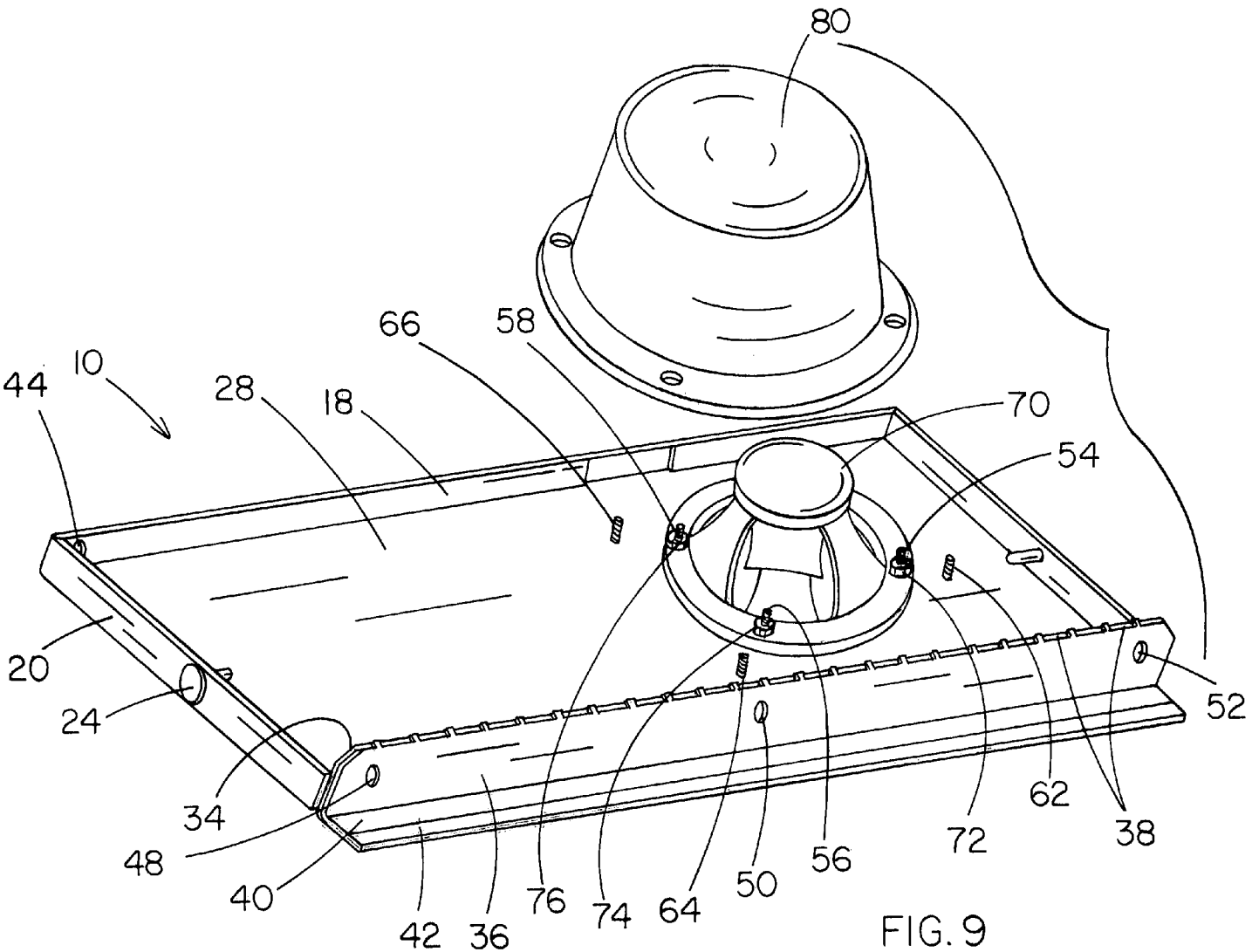
FIG. 9 is an exploded view of the system of FIG. 8, showing a speaker mounted directly to the upper surface of a strengthening plate on the base of the system in normal use position.

Plate 28 provides a solid surface for the installation of one or more speakers, for example 8" coaxial, 8" dual cone, or 4" high compliance driver with 70V or 25/70V transformer. Plate 28 includes speaker anchoring bolts 54, 56, 58 and 60 and back box anchoring bolts 62, 64, 66 and 68. As is illustrated in FIG. 9, a speaker 70 is mounted to plate 28 at the bolts and secured in place with nuts 72, 74, 76 and 78 (not shown). A back box 80 is optionally mounted over the speaker 70 and secured by nuts 82, 84, 86 and 88 (not shown).

Figure 10:
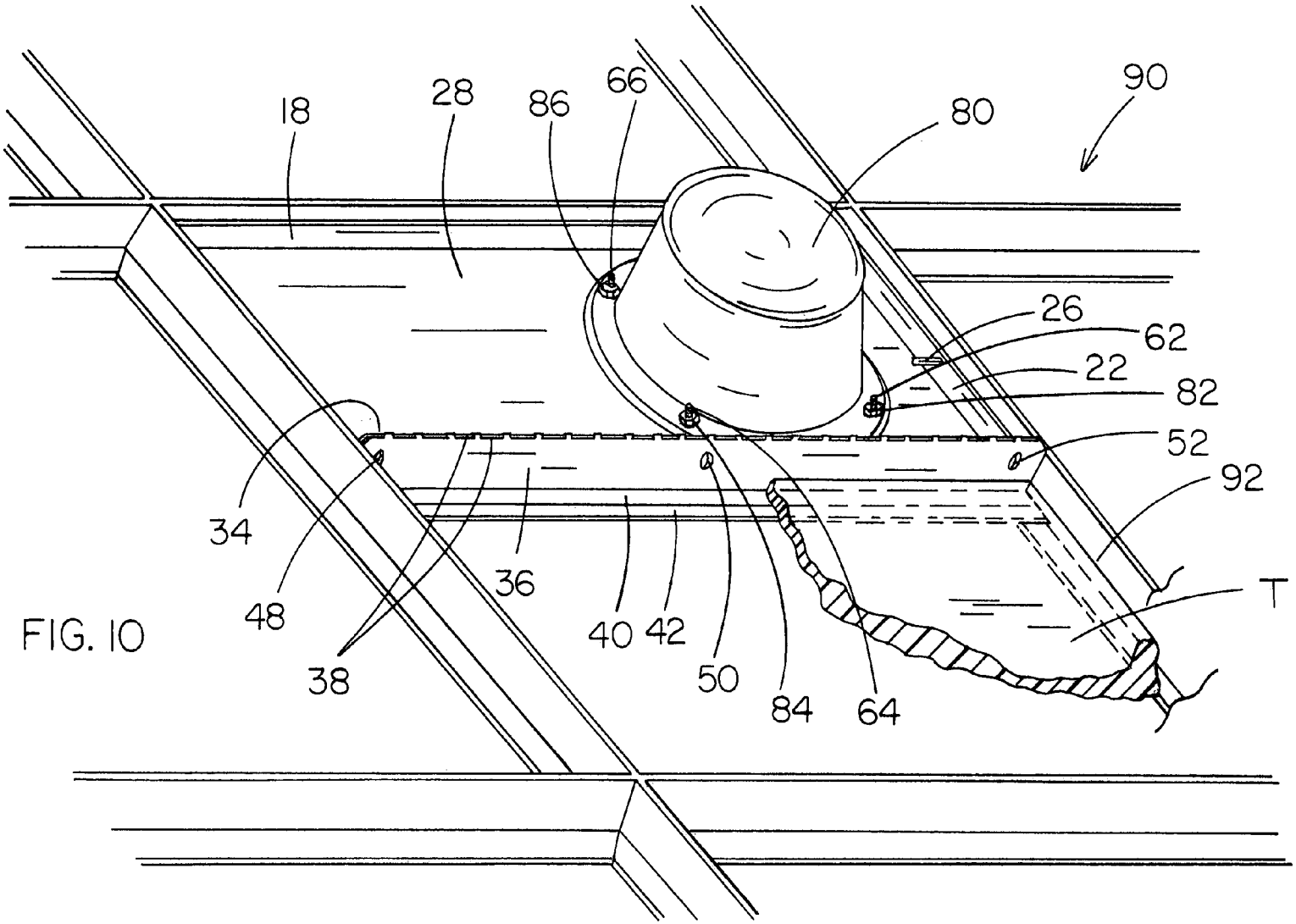
FIG. 10 is a perspective view of the system of FIG. 8 assembled onto an area of suspended ceiling grid, with a section of ceiling tile shown in place, broken away, to illustrate how such tiles are supported within the ceiling adjacent the new system.

System 10 is shown installed in FIG. 10 into a standard two by two foot grid opening of a suspended ceiling generally designated 90, the ceiling having T-shaped supports 92 onto which the ceiling tiles (not shown) are installed. The integral flanges 30,32 create a T-shaped support compatible with ceiling 90. Only a simple straight cut is required to size a ceiling panel to complete the grid opening onto which system 10 is installed.

From the foregoing description those skilled in the art will appreciate that all of the objects of the present invention are realized. A speaker support system that is quickly and easily manufactured and installed into a new or existing suspended ceiling is provided. The system provides an integral ceiling tile support eliminating the need to purchase, cut, and install a replacement grid member to support the adjacent tile, and is visually integrated into the ceiling. In addition, the system can be easily adapted to mount a variety of speaker sizes and types including both music and pager systems.

Having described the present invention in detail, those skilled in the art will appreciate that modifications may be made of the present invention without departing from its spirit and scope. The base size of about one by two feet is preferred, however the base may be sized to fit any ceiling grid opening or for use in any application. Likewise the system may be constructed of any material suitable for supporting the speaker without interfering with the speaker operation.

While the illustrated number and location of the bolts to secure the speaker is presently preferred, it is understood that any number and configuration, or any other means of securing the speaker and back box may be utilized. In addition, the holes in the flanges to secure the system to the building may vary in number and location, or any conventional means of securing known in the art may be utilized without affecting system operation. Finally, it is noted that while the system is shown with one speaker mounted off center, the number and location of the speakers may be varied to meet a particular application.

In view of the foregoing, it will be seen that the several objects of the invention are achieved and other advantages are attained. Although the foregoing includes a description of the best mode contemplated for carrying out the invention, various modifications are conceivable.

Therefore, it is not intended that the scope of the present invention be limited to the specific examples and embodiments described herein. It is also contemplated that other modifications and applications, or equivalents thereof, will occur to those skilled in the art. It is accordingly intended that the claims set forth below shall cover all such changes, modifications, variations and other uses and applications that do not depart from the spirit and scope of the present invention as described herein.

Other aspects, objects and advantages of the present invention can be obtained from a study of the disclosure and the appended claims.

What is claimed is:

1. A speaker support system adapted for use with a suspended ceiling of the type having a suspended ceiling grid including a plurality of ceiling grid openings and a plurality of ceiling panels sized to fit within the ceiling grid openings, the speaker support system comprising;

a speaker support base replacing at least part of a ceiling panel and having sufficient strength to support at least one speaker within a grid opening without interfering with the operation of the speaker;

a guide flange integral to the speaker support base, the guide flange providing a straight edge for aligning at least a portion of a ceiling tile within the ceiling grid opening; and a support flange integral to the support base and with the guide flange forming an upside down T-shape, the support flange supporting at least a portion of the ceiling tile within the ceiling grid opening so that at least a portion of the ceiling grid opening is filled with the speaker support base and the remaining portion of the ceiling grid opening is filled with the portion of the ceiling tile.

2. The speaker support system of claim 1 further including a support plate mounted to the speaker support base to strengthen the speaker support base.

3. The speaker support system of claim 1 further including at least one speaker mounted on the speaker support base.

4. The speaker support system of claim 1 wherein the speaker support base fills about a first half of the ceiling grid opening and the ceiling tile fills about the second half of the ceiling grid opening.

5. The speaker support system of claim 1 wherein the speaker support base fills about three quarters of the ceiling grid opening and the ceiling tile fills about one quarter of the ceiling grid opening.

6. The sneaker support system of claim 1 wherein the speaker support base, the guide flange and the support flange are formed from a single piece of material.

7. The speaker support system of claim 1 wherein the speaker support system base is perforated.

8. A speaker support system adapted for use with a suspended ceiling of the type having a suspended ceiling grid including a plurality of ceiling grid openings and a plurality of ceiling panels sized to fit within the ceiling grid openings, the speaker support system comprising;

a speaker support base replacing at least part of a ceiling panel and having sufficient strength to support at least one speaker within a grid opening without interfering with the operation of the speaker;

a plate mounted to the speaker support base to strengthen the speaker support base;

a guide flange integral to the speaker support base, the guide flange providing a straight edge for aligning at least a portion of a ceiling tile within the ceiling grid opening; and a support flange integral to the speaker support base and with the guide flange forming an upside down T-shape, the support flange supporting at least a portion of the ceiling tile within the ceiling grid opening, so that at least a portion of the ceiling grid opening is filled with the speaker support base and the remaining portion of the ceiling grid opening is filled with the portion of the ceiling tile.

9. The speaker support system of claim 8 further including at least one speaker mounted on the speaker support base.

10. The speaker support system of claim 8 wherein the speaker support base fills about a first half of the ceiling grid opening and the ceiling tile fills about the second half of the ceiling grid opening.

11. The speaker support system of claim 8 wherein the speaker support base fills about three quarters of the ceiling grid opening and the ceiling tile fills about one quarter of the ceiling grid opening.

12. The speaker support system of claim 8 wherein the speaker support base, the guide flange and the support flange are formed from a single piece of material.

13. The speaker support system of claim 8 wherein the speaker support system base is perforated.

14. A speaker support system adapted for use with a suspended ceiling of the type having a suspended ceiling grid including a plurality of ceiling grid openings and a plurality of ceiling panels sized to fit within the ceiling grid openings, the speaker support system comprising;

a speaker support base replacing at least part of a ceiling panel having sufficient strength to support at least one speaker in alignment with a grid opening without interfering with the operation of the speaker;

a guide flange integral to the speaker support base, the guide flange providing a straight edge for aligning at least a portion of a ceiling tile within the ceiling grid opening;

a support flange integral to the support base and with the guide flange forming an upside down T-shape, the support flange supporting at least a portion of the ceiling tile within the ceiling grid opening, the speaker support base, the guide flange and the support flange being formed from substantially a single sheet of material, so that at least a portion of the ceiling grid opening is filled with the speaker support base and the remaining portion of the ceiling grid opening is filled with the portion of the ceiling tile; and a plate disposed adjacent and parallel to the speaker support base to thereby strengthen the speaker support base.

15. The speaker support system of claim 14 wherein the speaker support base fills about a first half of the ceiling grid opening and the ceiling tile fills about the second half of the ceiling grid opening.

16. The speaker support system of claim 14 wherein the speaker support base fills about three quarters of the ceiling grid opening and the ceiling tile fills about one quarter of the ceiling grid opening.

17. The speaker support system of claim 14 wherein the speaker support system base is perforated.

18. The speaker support system of claim 17 wherein the plate includes an aperture and the speaker support system base is perforated with a plurality of closely spaced apart perforations in an area in alignment with the aperture in the plate to thereby provide a site for position of a speaker on the speaker support system which position permits free passage of sound from the speaker through the speaker support system.

19. The speaker support system of claim 14 further including at least one speaker mounted to the support plate.

* * * * *

UNITED STATES PATENT AND TRADEMARK OFFICE

CERTIFICATE OF CORRECTION

PATENT NO. : 7,120,269 B2
APPLICATION NO. : 09/972465
DATED : October 10, 2006
INVENTOR(S) : Lowell et al.

It is certified that error appears in the above-identified patent and that said Letters Patent is hereby corrected as shown below:

| Col./Line No. | Reads | Should read |
|---|---|---|
| Col. 5, Line 1 | "6. The sneaker support" | -- 6. The speaker support -- |

Signed and Sealed this

Nineteenth Day of December, 2006

JON W. DUDAS
*Director of the United States Patent and Trademark Office*